US008305305B2

(12) United States Patent
Ono

(10) Patent No.: US 8,305,305 B2
(45) Date of Patent: Nov. 6, 2012

(54) IMAGE DISPLAY DEVICE

(75) Inventor: Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 277 days.

(21) Appl. No.: 12/652,951

(22) Filed: Jan. 6, 2010

(65) Prior Publication Data

US 2010/0109985 A1 May 6, 2010

Related U.S. Application Data

(63) Continuation of application No. PCT/JP2008/001662, filed on Jun. 26, 2008.

(30) Foreign Application Priority Data

Jul. 19, 2007 (JP) ..... 2007-187909

(51) Int. Cl.
*G09G 3/30* (2006.01)

(52) U.S. Cl. ..... 345/76; 313/498

(58) Field of Classification Search ..... 345/76
See application file for complete search history.

(56) References Cited

U.S. PATENT DOCUMENTS

| | | | | |
|---|---|---|---|---|
| 2003/0062545 | A1 | 4/2003 | Yamazaki et al. | |
| 2006/0022305 | A1 * | 2/2006 | Yamashita | 257/565 |
| 2006/0103322 | A1 | 5/2006 | Chung et al. | |
| 2007/0018917 | A1 | 1/2007 | Miyazawa | |
| 2007/0063993 | A1 * | 3/2007 | Shishido | 345/175 |
| 2008/0088546 | A1 | 4/2008 | Takasugi et al. | |
| 2009/0231308 | A1 * | 9/2009 | Numao | 345/204 |
| 2009/0262139 | A1 | 10/2009 | Tanaka et al. | |
| 2009/0268095 | A1 | 10/2009 | Hoshino et al. | |
| 2009/0323033 | A1 | 12/2009 | Konishi et al. | |
| 2010/0033692 | A1 | 2/2010 | Watanabe et al. | |
| 2010/0039426 | A1 | 2/2010 | Matsumoto et al. | |

FOREIGN PATENT DOCUMENTS

| | | |
|---|---|---|
| JP | 2002-514320 | 5/2002 |
| JP | 2003-216104 | 7/2003 |
| JP | 2004-246204 | 9/2004 |
| JP | 2006-023515 | 1/2006 |
| JP | 2006-138953 | 6/2006 |
| JP | 2007-033599 | 2/2007 |
| WO | 98/48403 | 10/1998 |
| WO | 2006/090560 | 8/2006 |

* cited by examiner

*Primary Examiner* — Amare Mengistu
*Assistant Examiner* — Vinh Lam
(74) *Attorney, Agent, or Firm* — Greenblum & Bernstein, P.L.C.

(57) ABSTRACT

An image display device in which a plurality of pixel circuits are arranged has a current light-emitting element, a driver transistor for flowing current in the current light-emitting element, a retention capacitor for retaining a voltage determining an amount of current flowed from the driver transistor, and a writing switch for writing a voltage depending on an image signal to the retention capacitor. Transistors configuring the respective pixel circuits are an N-channel type transistor, each of the pixel circuits further includes an enable switch, an initialization capacitor for initializing the voltage of the retention capacitor, and a separation switch.

7 Claims, 7 Drawing Sheets

IMAGE DISPLAY DEVICE

CROSS REFERENCE TO RELATED APPLICATION

This application is a continuation of PCT International Application No. PCT/JP2008/001662, filed Jun. 26, 2008, which is hereby incorporated by reference as though set forth in full herein. Priority of Japanese Application No. 2007-187909, filed Jul. 19, 2007, was claimed in the International Application and is also claimed herein, and the entire subject matter thereof is incorporated by reference herein.

FIELD OF THE INVENTION

The present invention relates to an active matrix-type image display device using a current light-emitting element.

DESCRIPTION OF RELATED ART

An organic EL display device in which a great number of organic electroluminescence (EL) elements that emit light from themselves are arranged does not require a backlight. Thus, the organic EL display device has been expected as the next-generation image display device.

The organic EL element is a current light-emitting element that controls the brightness depending on the amount of current flowing therethrough. Methods for driving the organic EL element include the simple matrix method and the active matrix method. The former provides a simple pixel circuit but has a difficulty in realizing a large and high-resolution image display device. Thus, in recent years, an active matrix-type organic EL display device has been vigorously developed in which pixel circuits are arranged each of which has a driver transistor for driving a current light-emitting element provided in each organic EL element.

A driver transistor and the peripheral circuit thereof are generally formed by a thin film transistor. A thin film transistor is classified to the one using polysilicon and the one using amorphous silicon. An amorphous silicon thin film transistor is suitable for a large organic EL display device because, although the amorphous silicon thin film transistor is disadvantageous in its small mobility and high temporal change in the threshold voltage, the mobility is uniform and a larger size is achieved easily and with a low cost. The disadvantage of the temporal change of the threshold voltage of the amorphous silicon thin film transistor has been tried to be solved by a method by the modification of a pixel circuit. For example, Patent Publication 1 discloses an organic EL display device including a pixel circuit. This pixel circuit prevents, even when a threshold voltage of a thin film transistor changes, the amount of current flowing in the current light-emitting element from being influenced by the threshold voltage to thereby provide a stable image display.

[Patent Publication 1] Japanese translation of PCT publication No. 2002-514320

SUMMARY OF THE INVENTION

In the image display device of the present invention, a pixel circuits is arranged. The pixel circuit includes a current light-emitting element; an N-type driver transistor for flowing current in the current light-emitting element; a retention capacitor for retaining a retention voltage applied to the N-type transistor; an N-type writing switch transistor for writing the retention voltage to the retention capacitor based on an image signal; an N-type enable switch transistor wherein a drain of the N-type enable switch transistor is connected to a source of the N-type driver transistor and a source of the N-type enable switch transistor is connected to an anode of the current light-emitting element; an initialization capacitor; and an N-type separation switch transistor. A first electrode of the retention capacitor is connected to a gate of the N-type driver transistor and a second electrode of the retention capacitor is connected to a first electrode of the initialization capacitor. A second electrode of the initialization capacitor is connected to a trigger line, the trigger line supplying a trigger signal for initializing the retention voltage of the retention capacitor. A drain of the N-type separation switch transistor is connected to the second electrode of the retention capacitor and the first electrode of the initialization capacitor, A source of the N-type separation switch transistor is connected to a source of the N-type driver transistor.

Furthermore, the trigger signal supplied to the trigger line is a control signal for controlling the N-type enable switch transistor.

Furthermore, the pixel circuit includes an N-type reference switch transistor for applying a reference voltage to the gate of the N-type driver transistor.

Furthermore, the image display device comprises a plurality of pixel circuits.

The pixel circuit of the present invention comprises a current light-emitting element; an N-type driver transistor for flowing current in the current light-emitting element; a retention capacitor for retaining a retention voltage applied to the N-type transistor; an N-type writing switch transistor for writing the retention voltage to the retention capacitor based on an image signal; an N-type enable switch transistor wherein a drain of the N-type enable switch transistor is connected to a source of the N-type driver transistor and a source of the N-type enable switch transistor is connected to an anode of the current light-emitting element; an initialization capacitor; and an N-type separation switch transistor. A first electrode of the retention capacitor is connected to a gate of the N-type driver transistor and a second electrode of the retention capacitor is connected to a first electrode of the initialization capacitor. A second electrode of the initialization capacitor is connected to a trigger line, the trigger line supplying a trigger signal for initializing the retention voltage of the retention capacitor. A drain of the N-type separation switch transistor is connected to the second electrode of the retention capacitor and the first electrode of the initialization capacitor. A source of the N-type separation switch transistor is connected to a source of the N-type driver transistor.

DETAILED DESCRIPTION OF PREFERRED EMBODIMENTS

The following section will describe an active matrix-type image display device in an embodiment of the present invention with reference to the drawings. The following section will describe, as an image display device, an active matrix-type organic EL display device that uses a thin film transistor to cause an organic EL element to emit light. However, the present invention can be applied to general active matrix-type image display devices using a current light-emitting element that controls the brightness depending on the amount of current flowing therethrough.

Embodiment

Figure 1:
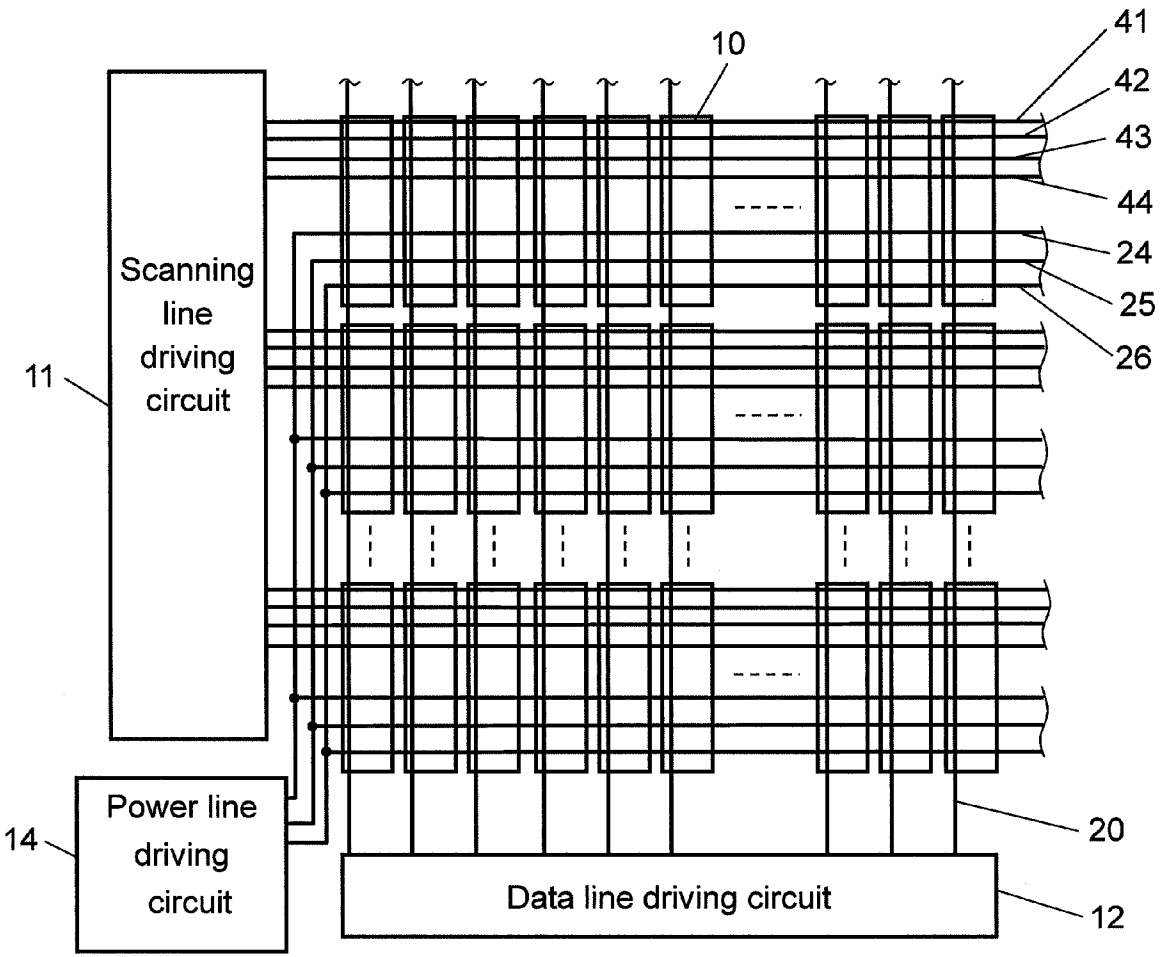
FIG. 1 is a schematic view illustrating the configuration of an organic EL display device in an embodiment of the present invention.

FIG. 1 is a schematic view illustrating the configuration of an organic EL display device in an embodiment of the present invention.

The organic EL display device in this embodiment includes: pixel circuits 10 arranged in a matrix-like manner; scanning line driving circuit 11; data line driving circuit 12; and power line driving circuit 14. Scanning line driving circuit 11 supplies scanning signal scn, reset signal rst, trigger signal trg, and merge signal mrg to pixel circuits 10, respectively. Data line driving circuit 12 supplies data signal DATA corresponding to an image signal to pixel circuits 10. Power line driving circuit 14 supplies power to pixel circuits 10. In this embodiment, description is made based on an assumption that pixel circuits 10 are arranged in a matrix form of n rows and m columns.

Scanning line driving circuit 11 supplies scanning signals scn independently to scanning line 41 commonly connected to pixel circuits 10 arranged in the row direction in FIG. 1. Scanning line driving circuit 11 supplies reset signals rst independently to reset line 42 also commonly connected to pixel circuits 10 arranged in the row direction, Scanning line driving circuit 11 supplies trigger signals trg independently to trigger line 43 also commonly connected to pixel circuits 10 arranged in the row direction. Scanning line driving circuit 11 supplies merge signals mrg independently to merge line 44 also commonly connected to pixel circuits 10 arranged in the row direction. Data line driving circuit 12 supplies data signal DATA independently to data lines 20 commonly connected to pixel circuits 10 arranged in the column direction in FIG. 1. In this embodiment, the number of each of scanning lines 41, reset lines 42, trigger lines 43, and merge lines 44 is n and the number of data lines 20 is m. However, the numbers of scanning lines 41, reset lines 42, trigger lines 43, and merge lines 44 also may not be the same.

Power line driving circuit 14 supplies power to high voltage-side power line 24 and low voltage-side power line 25 commonly connected to all of pixel circuits 10. Power line driving circuit 14 also supplies reference voltage Vref to reference voltage line 26 commonly connected to all pixel circuits 10.

Figure 2:
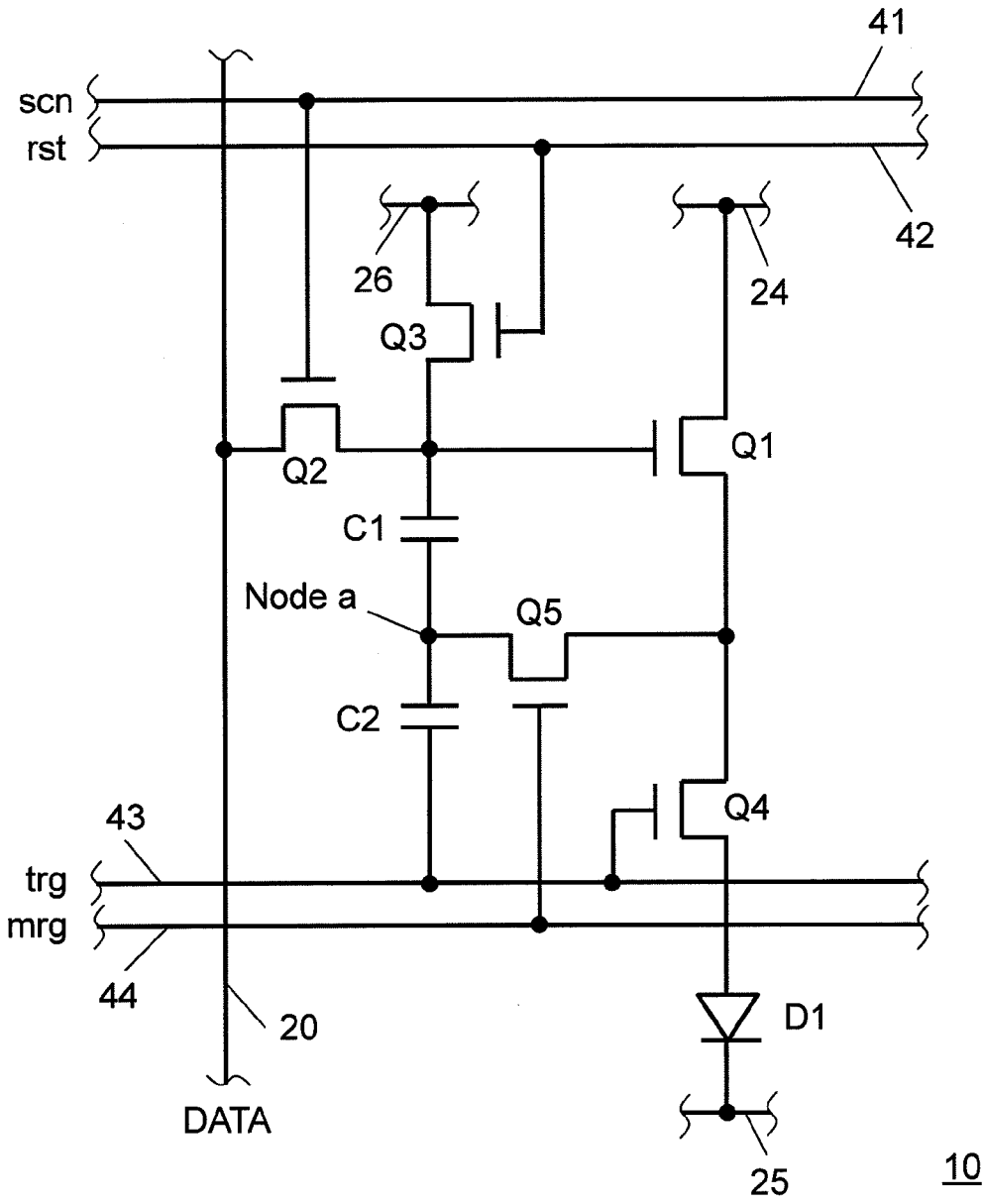
FIG. 2 is a circuit diagram illustrating a pixel circuit in the embodiment of the present invention.

FIG. 2 is a circuit diagram illustrating pixel circuits 10 in an embodiment of the present invention.

Each of pixel circuits 10 in this embodiment includes: organic EL element D1 as a current light-emitting element; driver transistor Q1; retention capacitor C1; transistor Q2; transistor Q3; transistor Q4; and transistor Q5. Driver transistor Q1 flows current in organic EL element D1 to cause organic EL element D1 to emit light. Retention capacitor C1 retains a voltage for determining an amount of current flowed from driver transistor Q1. Transistor Q2 is a writing switch for writing a voltage depending on an image signal to retention capacitor C1. Transistor Q3 is a reference switch for applying reference voltage Vref to a gate of driver transistor Q1. Transistor Q4 is an enable switch inserted to a current pathway for flowing current in organic EL element D1. Transistor Q5 is a separation switch for separating retention capacitor C1 from a source of driver transistor Q1 when a voltage is written to retention capacitor C1. Each of pixel circuits 10 further includes initialization capacitor C2 that applies a voltage exceeding threshold voltage Vth of driver transistor Q1 to retention capacitor C1 to initialize the voltage of retention capacitor C1. Driver transistor Q1 and transistors Q2 to Q5 configuring pixel circuits 10 are all N-channel thin film-type transistors. Although the following section will describe transistors Q2 to Q5 as an enhancement-type transistor, transistors Q2 to Q5 also may be a depression-type transistor.

A drain of transistor Q4 as an enable switch is connected to a source of driver transistor Q1. A source of transistor Q4 is connected to an anode of organic EL element D1. Specifically, a drain of driver transistor Q1 is connected to high voltage-side power line 24. A source of driver transistor Q1 is connected to a drain of transistor Q4. A source of transistor Q4 is connected to an anode of organic EL element D1. A cathode of organic EL element D1 is connected to low voltage-side power line 25. Here, a voltage supplied to high voltage-side power line 24 is 5(V) for example. A voltage supplied to low voltage-side power line 25 is −15(V) for example.

One of terminals, or a first electrode, of retention capacitor C1 is connected to a gate of driver transistor Q1. The other of the terminals, or a second electrode, of retention capacitor C1 is connected to one of terminals, or a first electrode, of initialization capacitor C2. The other of the terminals, or a second electrode, of initialization capacitor C2 is connected to trigger line 43 through which trigger signal trg for initializing the voltage of retention capacitor C1 is supplied. A drain of transistor Q5 as a separation switch is connected to a node point at which retention capacitor C1 is connected to initialization capacitor C2 (hereinafter referred to as "node point a"). In other words, the drain of the N-type separation switch transistor is connected to the second electrode of the retention capacitor and the first electrode of the initialization capacitor. A source of transistor Q5 is connected to a source of driver transistor Q1.

A gate of driver transistor Q1 is connected to data line 20 via transistor Q2 as a writing switch and is connected to reference voltage line 26 via transistor Q3 as a reference switch.

A gate of transistor Q2 is connected to scanning line 41. A gate of transistor Q3 is connected to reset line 42. A gate of transistor Q5 is connected to merge line 44. Although a gate of transistor Q4 is connected to trigger line 43, the reason is that, in this embodiment, trigger signal trg supplied to trigger line 43 also functions as a control signal for controlling transistor Q4. A control signal for controlling transistor Q4 also may be independently provided. However, trigger signal trg also functioning as a control signal can reduce the wiring to thereby simplify pixel circuit 10.

Figure 3:
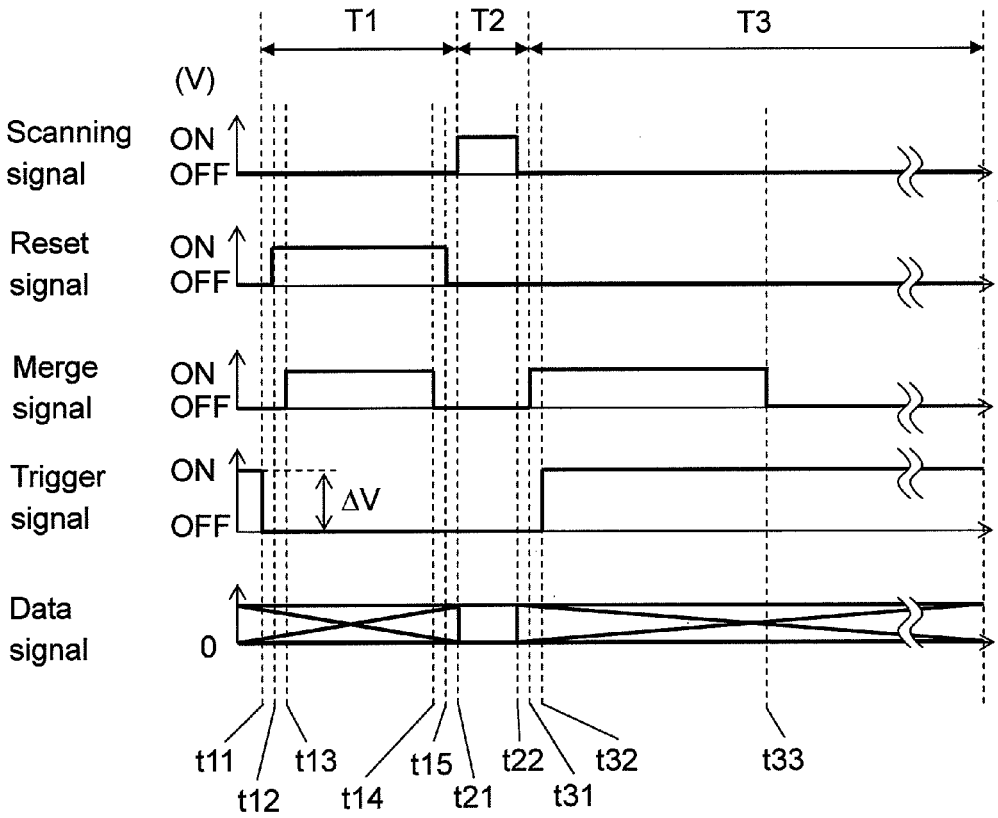
FIG. 3 is a timing chart illustrating the operation of the pixel circuit in the embodiment of the present invention.

Next, the following section will describe the operation of pixel circuit 10 in this embodiment. FIG. 3 is a timing chart illustrating the operation of pixel circuit 10 in an embodiment of the present invention. In this embodiment, each of pixel circuits 10 performs an operation for detecting, within one field period, threshold voltage Vth of driver transistor Q1, an operation for writing data signal DATA corresponding to an image signal to retention capacitor C1, and an operation for causing organic EL element D1 to emit light based on a voltage written to retention capacitor C1. For convenience, a period during which threshold voltage Vth is detected is assumed as threshold detection period T1, a period during which data signal DATA is written is assumed as writing period T2, and a period during which organic EL element D1 is caused to emit light is assumed as light-emitting period T3. Based on this assumption, the details of the operation will be described. Threshold detection period T1, writing period T2, and light-emitting period T3 are defined to each of pixel circuits 10. Thus, the above three periods do not have to have congruent phases with regard to all of pixel circuits 10. In this embodiment, pixel circuits 10 arranged in the row direction are driven to have congruent phases during the three periods and pixel circuits 10 arranged in the column direction are driven to have dislocated phases during the three periods so that writing periods T2 of the respective pixel circuits are not congruent to one another. By the driving by the dislocated phases as described above, light-emitting period T3 can be extended, which is desirably for improving the image display brightness.

(Threshold Detection Period T1)

Figure 4:
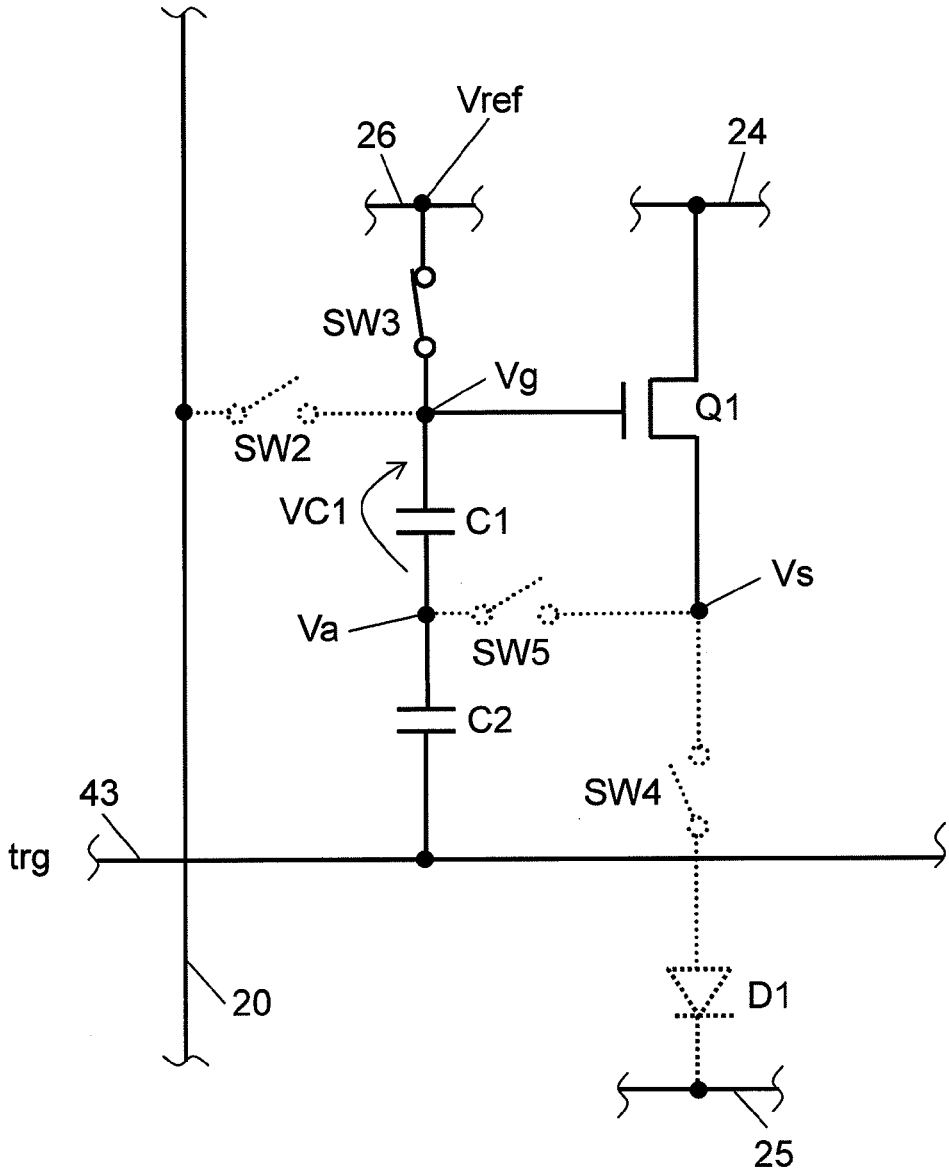
FIG. 4 is a circuit diagram for explaining the operation of an image display device in a threshold detection period in the embodiment of the present invention.

FIG. 4 is a circuit diagram for explaining the operation of the image display device in threshold detection period T1 in an embodiment of the present invention. In FIG. 4, transistors Q2 to Q5 of FIG. 2 are substituted with switches SW2 to SW5 for description.

First, at a timing prior to threshold detection period T1 (i.e., second half of the light-emitting period one field before), scanning signal scn, reset signal rst, and merge signal mrg are at a low level and trigger signal trg is at a high level, respectively. Thus, switch SW2, switch SW3, and switch SW5 are in an OFF status and switch SW4 is in an ON status. When assuming that voltage VC1 between terminals of retention capacitor C1 at the time is voltage VC1(0) and source voltage Vs of driver transistor Q1 is voltage Vs(0), then voltage Va of node point a is equal to voltage Vs(0) as described later. Specifically, when assuming that a gate voltage of driver transistor Q1 is voltage Vg, then the following formula is established.

$$Vg=Vs(0)+VC1(0)$$

$$Va=Vs(0) \qquad \text{[Formula 1]}$$

At first time t11 of threshold detection period T1, trigger signal trg is at a low level and switch SW4 is in an OFF status. When assuming that a difference between a high level voltage and a low level voltage of trigger signal trg is voltage difference ΔV, then gate voltage Vg of driver transistor Q1 and voltage Va of node point a drop by voltage difference ΔV. Then, gate voltage Vg and voltage Va of node point a are as shown in the following formula.

$$Vg=Vs(0)+VC1(0)-\Delta V$$

$$Va=Vs(0)-\Delta V \qquad \text{[Formula 2]}$$

At the subsequent time t12, reset signal rst is at a high level and switch SW3 is in an ON status. Then, gate voltage Vg of driver transistor Q1 equals to reference voltage Vref and voltage Va of node point a also changes, resulting in the following formula.

$$Vg = Vref \qquad \text{[Formula 3]}$$

$$\begin{aligned} Va &= \{Vs(0)-\Delta V\} + \frac{C1}{C1+C2}\cdot[Vref-\{Vs(0)+VC1(0)-\Delta V\}] \\ &= \frac{C2}{C1+C2}\cdot\{Vs(0)-\Delta V\} + \frac{C1}{C1+C2}\cdot\{Vref-VC1(0)\} \end{aligned}$$

Thus, voltage VC1 between terminals of retention capacitor C1 is as shown in the following formula.

$$\begin{aligned} VC1 &= Vg - Va \qquad \text{[Formula 4]} \\ &= Vref - \frac{C2}{C1+C2}\cdot\{Vs(0)-\Delta V\} - \frac{C1}{C1+C2}\cdot\{Vref-VC1(0)\} \\ &= \frac{C1}{C1+C2}\cdot VC1(0) + \frac{C2}{C1+C2}\cdot\Delta V + \frac{C2}{C1+C2}\cdot\{Vref-Vs(0)\} \end{aligned}$$

What is important here is that, when switch SW3 is in an ON status and then switch SW5 is in an ON status, voltage Va of node point a is sufficiently low so that driver transistor Q1 can be in an ON status. In other words, voltage VC1 between terminals of retention capacitor C1 at the time is sufficiently high when compared to threshold voltage Vth. For example, in this embodiment, it is assumed that Vs(0)=−5(V), Vref=0 (V), VC1(0)=0(V), and ΔV=30(V), are established and a capacity of retention capacitor C1 and a capacity of initialization capacitor C2 are equal. Then, voltage VC1 between the terminals of retention capacitor C1 is 17.5(V) and source voltage Va of driver transistor Q1 is −17.5(V), which is sufficiently high when compared to threshold voltage Vth. Thus, driver transistor Q1 can be in an ON status.

Next, at time t13, merge signal mrg is at a high level and switch SW5 is in an ON status. Then, retention capacitor C1 charged to have a voltage higher than that of threshold voltage Vth is connected between a gate and a source of driver transistor Q1 via switch SW5. Thus, driver transistor Q1 is in an ON status and the charge of retention capacitor C1 is discharged and source voltage Vs of driver transistor Q1 starts to increase. Then, when gate-to-source voltage Vgs of driver transistor Q1 is equal to threshold voltage Vth, driver transistor Q1 is in an OFF status. Thus, voltage VC1 between the terminals of retention capacitor C1 is equal to threshold voltage Vth. Specifically, the following formula is established.

$$VC1=Vth \qquad \text{[Formula 5]}$$

Thereafter, at time t14, merge signal mrg is at a low level and switch SW5 is in an OFF status. Then, at time t15, reset signal rst is at a low level and switch SW3 is in an OFF status.

(Writing Period T2)

Figure 5:
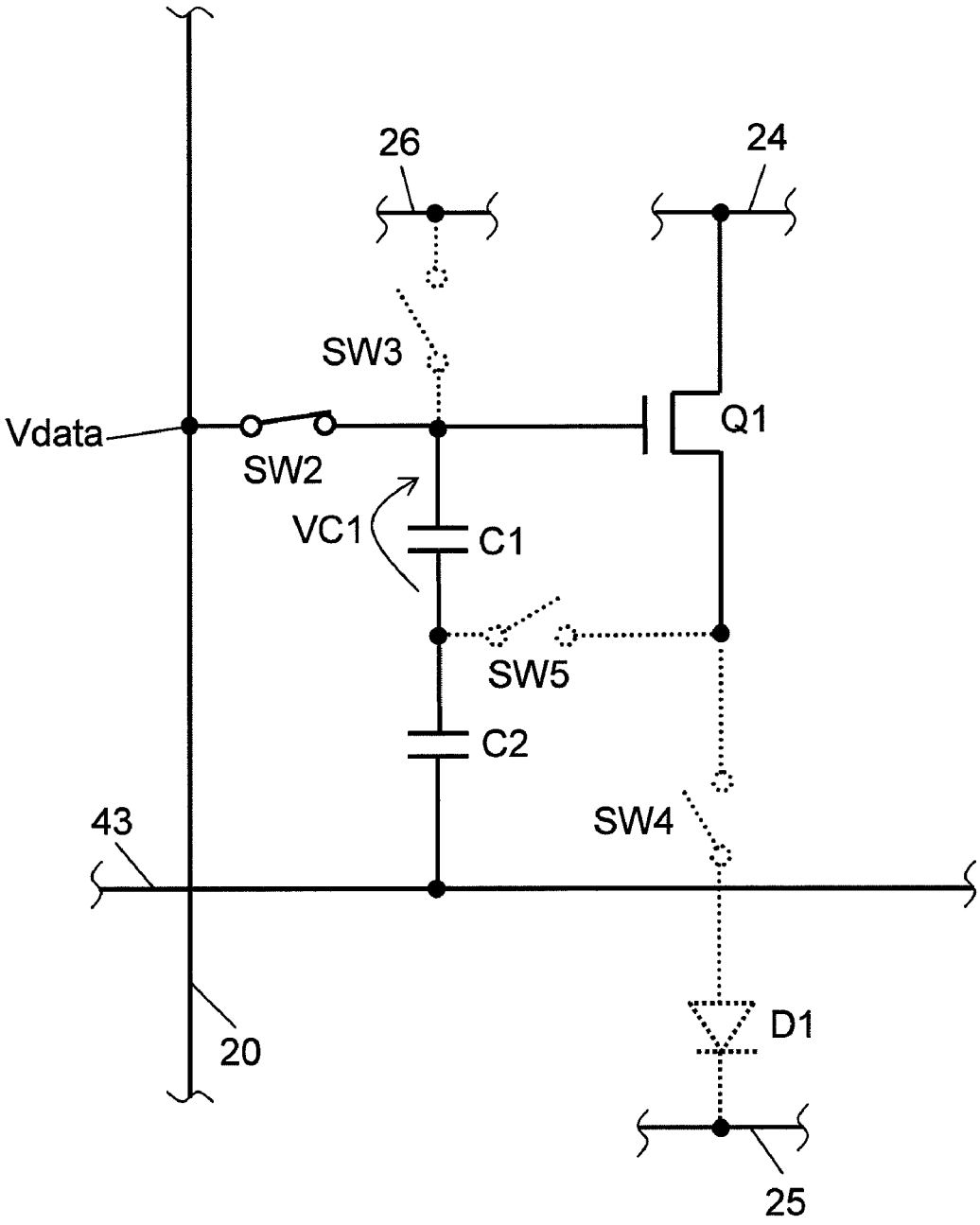
FIG. 5 is a circuit diagram for explaining the operation of the image display device in a writing period in the embodiment of the present invention.

FIG. 5 is a circuit diagram illustrating the operation of the image display device in writing period T2 in an embodiment of the present invention.

At time t21 of writing period T2, scanning signal Scn is at a high level and switch SW2 is in an ON status. Then, voltage Vdata corresponding to data signal DATA supplied to data line 20 is applied on one of terminals of retention capacitor C1. Thus, voltage VC1 of retention capacitor C1 increases by a voltage obtained by capacity-dividing voltage Vdata by retention capacitor C1 and initialization capacitor C2, thus resulting in the following formula.

$$VC1 = Vth + \frac{C2}{C1 + C2} \cdot Vdata \quad \text{[Formula 6]}$$

Then, at time t22, scanning signal Scn is at a low level and switch SW2 is in an OFF status.

(Light-Emitting Period T3)

Figure 6:
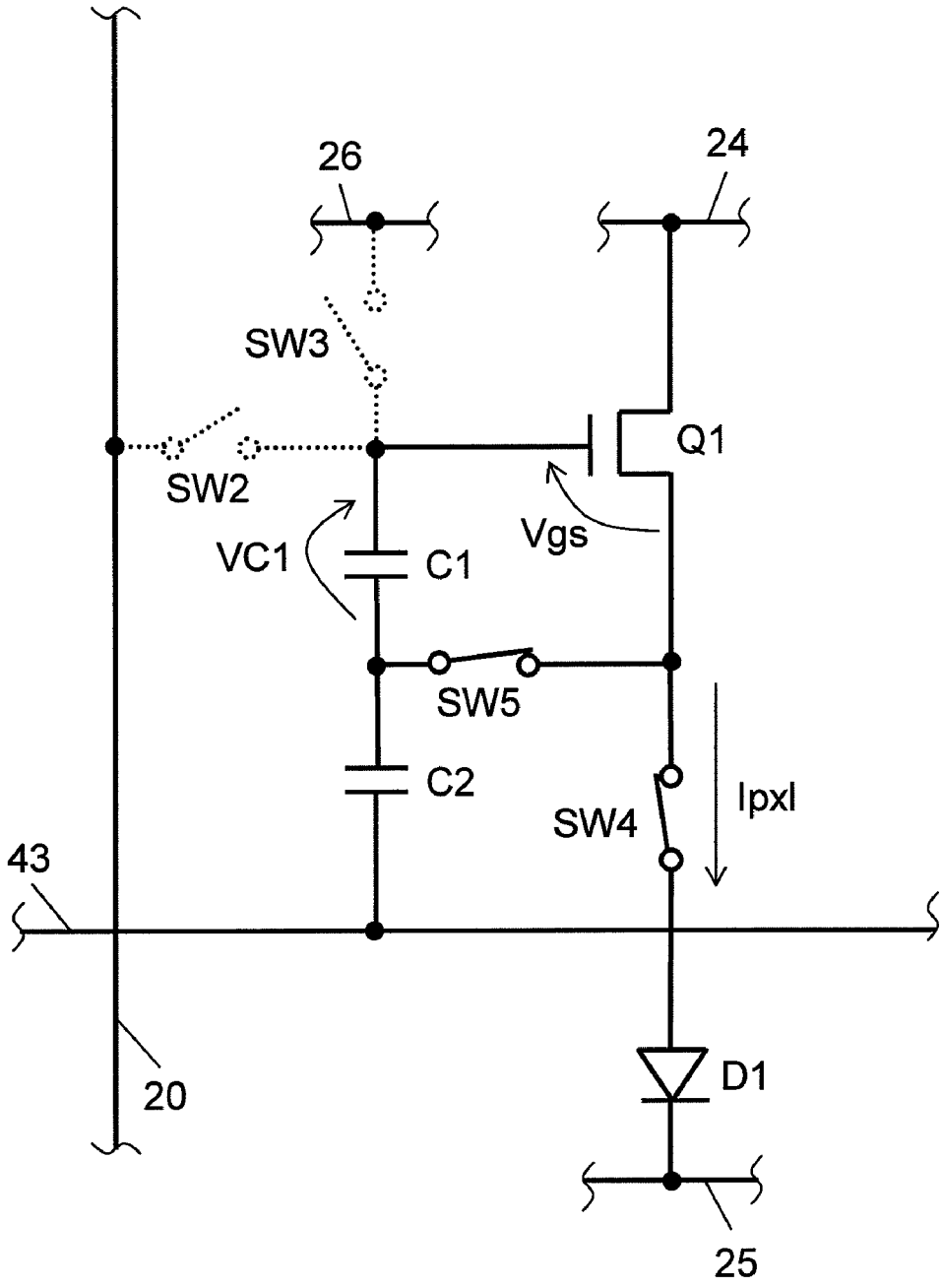
FIG. 6 is a circuit diagram for explaining the operation of the image display device in a light-emitting period in the embodiment of the present invention.

FIG. 6 is a circuit diagram illustrating the operation of the image display device in light-emitting period T3 in an embodiment of the present invention.

At time t31, merge signal mrg is at a high level and switch SW5 is in an ON status. As a result, gate-to-source voltage Vgs of driver transistor Q1 is equal to voltage VC1 between the terminals of retention capacitor C1.

Next, at time t32, trigger signal trg is at a high level and switch SW4 is in an ON status. Then, current flows in organic EL element D1 and organic EL element D1 emits light having the brightness corresponding to that of the image signal. Then, current Ipx1 flowing in organic EL element D1 is as shown in the following formula.

$$Ipxl = \frac{\beta}{2} \cdot (Vgs - Vth)^2 = \frac{\beta}{2}\left(\frac{C2}{C1 + C2} \cdot Vdata\right)^2 \quad \text{[Formula 7]}$$

In the formula, β denotes a coefficient determined depending on mobility μ of driver transistor Q1, gate insulating film capacity Cox, channel length L, and channel width W.

$$\beta = \mu \cdot \mathrm{Cox} \cdot \frac{W}{L} \quad \text{[Formula 8]}$$

As described above, current Ipx1 flowing in organic EL element D1 does not include the term of threshold voltage Vth. Thus, current Ipx1 flowing in organic EL element D1 is not influenced even by a fluctuation of threshold voltage Vth of driver transistor Q1 due to a temporal change.

Then, at time t33 after which source voltage Vs of driver transistor Q1 is equal to voltage Va of node point a, merge signal mrg is at a low level and switch SW5 is in an OFF status. However, even when switch SW5 is in an OFF status, gate voltage Vg of driver transistor Q1 does not change. Specifically, voltage Va of node point a is still equal to source voltage Vs of driver transistor Q1 and current Ipx1 flowing in organic EL element D1 also does not change.

In this embodiment, the terms of threshold detection period T1, writing period T2, and light-emitting period T3 were set to 1 ms, 16 μs, and 15 ms, respectively. However, these terms are desirably optimally set depending on the characteristic of organic EL element D1, the capacity of retention capacitor C1, and the characteristics of the respective elements configuring pixel circuit 10 for example. The terms also may be set depending on the image type by, for example, increasing the term of light-emitting period T3 in order to increase the brightness of a still image and by slightly reducing the term of light-emitting period T3 in order to consider the light-emitting response speed of a moving image.

In the above description, the voltage of high voltage-side power line 24 was 5(V) and the voltage of low voltage-side power line 25 was −15(V), and reference voltage Vref was 0(V). However, these voltage values are also desirably optimally set depending on the characteristics of the respective elements configuring pixel circuit 10. When driver transistor Q1 is an enhancement-type transistor for example, reference voltage Vref can be equal to the voltage of high voltage-side power line 24 to thereby omit reference voltage line 26. Furthermore, this omitting can simplify the respective elements of pixel circuit 10 and the wiring layout.

Figure 7:
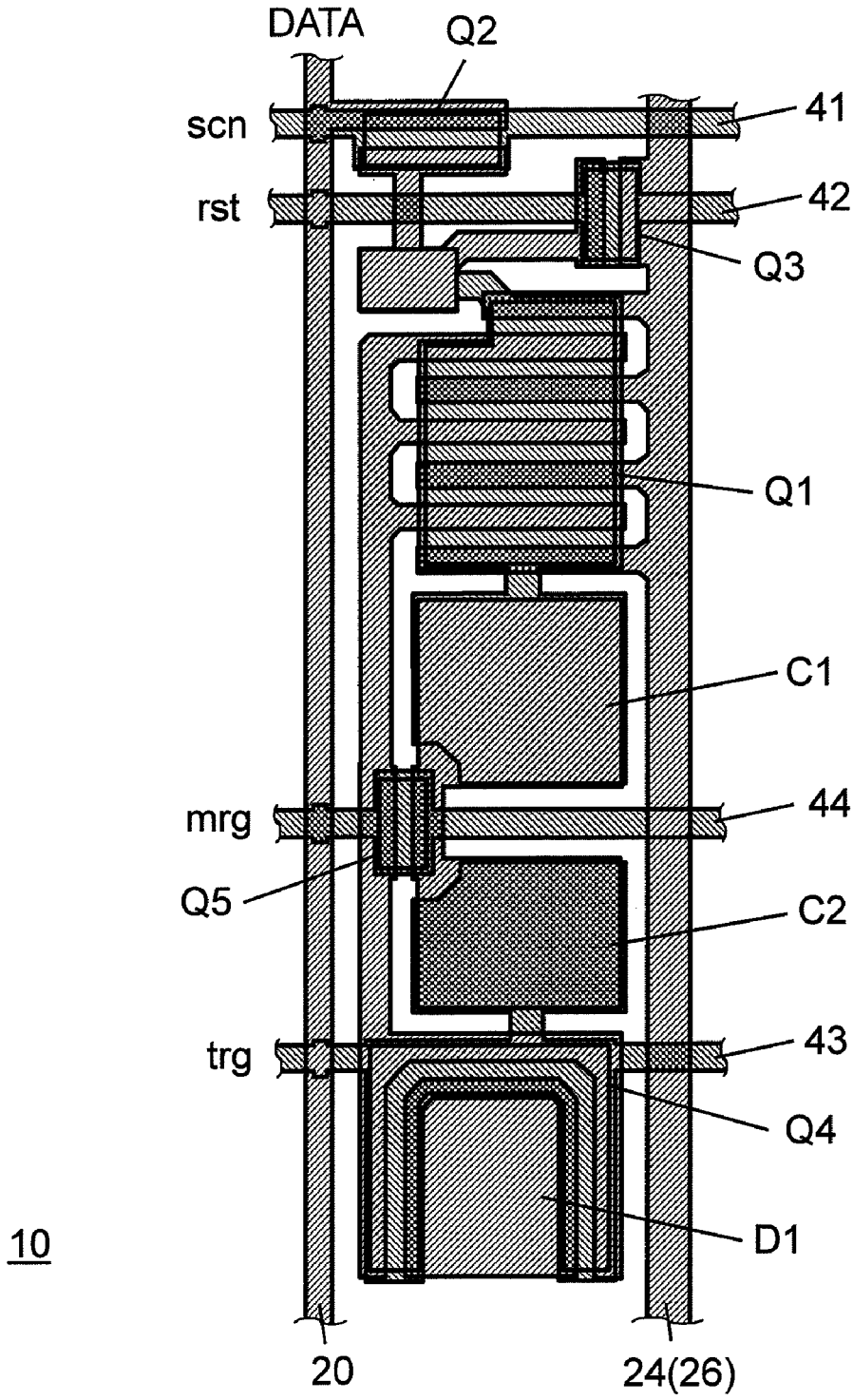
FIG. 7 illustrates an example of the layout of the respective elements of the pixel circuit in the embodiment of the present invention.

FIG. 7 illustrates an example of the layout of the respective elements of pixel circuits 10 when reference voltage Vref is set to equal to the voltage of high voltage-side power line 24 in the embodiment of the present invention. In FIG. 7, the respective elements configuring pixel circuits 10 (driver transistor Q1, transistors Q2 to Q5, retention capacitor C1, initialization capacitor C2, and organic EL element D1) are denoted with the same reference numerals as those of FIG. 2, respectively.

In FIG. 7, data line 20 is provided in the column direction at the left side of pixel circuits 10. High voltage-side power line 24 is provided in the column direction at the right side of pixel circuits 10. In FIG. 7, high voltage-side power line 24 also functions as reference voltage line 26. In FIG. 7, scanning line 41 is provided in the row direction at the upper side of pixel circuit 10, reset line 42 is provided in the row direction at the lower side of scanning line 41, merge line 44 is provided in the row direction at a further lower side, and trigger line 43 is provided in the row direction at a further lower side. Data line 20 and high voltage-side power line 24 provided in the column direction can be configured by the wiring of the first layer. Scanning line 41, reset line 42, merge line 44, and trigger line 43 provided in the row direction can be configured by the wiring of the second layer different from the first layer. As described above, by setting reference voltage Vref to be equal to the voltage of high voltage-side power line 24, the respective elements of pixel circuit 10 and the wiring layout can be simplified.

In this embodiment, the operation of pixel circuit 10 was described based on an assumption that the capacity of retention capacitor C1 is equal to the capacity of initialization capacitor C2. However, these capacity values are also desirably optimally set depending on the characteristics of the respective elements configuring pixel circuit 10 and driving conditions for example. For example, the capacity of retention capacitor C1 is desirably set sufficiently large so as to prevent a situation where the parasitic capacitance existing between the gate and source electrodes or between the gate and drain electrodes of driver transistor Q1 and off leak current of transistors Q2 and Q3 for example have an influence to cause a change in voltage VC1 between terminals during light-emitting period T3. Furthermore, the capacity of initialization capacitor C2 is desirably set so that data signal DATA can be written to retention capacitor C1 and retention capacitor C1 can be securely initialized.

As described above, according to this embodiment, current Ipx1 flowing in organic EL element D1 is not influenced even by a fluctuation of threshold voltage Vth of driver transistor Q1 due to a temporal change. Thus, organic EL element D1 is allowed to emit light with the brightness corresponding to the image signal. Furthermore, according to this embodiment, organic EL element D1 emits light in light-emitting period T3 with the brightness corresponding to the image signal and does not emit light regardless of the image signal during a reset period of retention capacitor C1 at the start of threshold detection period T1. Thus, according to this embodiment, an image having a high contrast can be displayed.

Furthermore, since the brightness of organic EL element D1 is determined by voltage VC1 between the terminals of retention capacitor C1, it is desirable that the driving is performed so that voltage VC1 between the terminals of retention capacitor C1 does not fluctuate unexpectedly. To realize this, the respective transistors can be controlled based on the sequence shown in FIG. 3 to thereby securely control the voltage of retention capacitor C1.

As described above, according to this embodiment, only an N-channel type transistor can be used to configure pixel circuit 10 in which the source of driver transistor Q1 is connected to organic EL element D1 and the cathode of organic EL element D1 is commonly connected to low voltage-side power line 25. Pixel circuit 10 in this embodiment is optimally used for a case where a large display device is configured by an amorphous silicon thin film transistor but also is desirably used for a case where an N-channel type polysilicon thin film transistor is used.

In this embodiment, the configuration has been described where pixel circuits 10 arranged in the row direction are driven so that the phases of the three periods of threshold detection period T1, writing period T2, and light-emitting period T3 are congruent and pixel circuits 10 arranged in the column direction are driven so that the phases of the three periods are dislocated from one another so as to prevent writing periods T2 of the respective circuits from being congruent to one another. However, the present invention is not limited to this. For example, one field period also may divided to three periods including threshold detection period T1, writing period T2, and light-emitting period T3 and all of pixel circuits 10 also may be driven in a synchronized manner. Specifically, by supplying reference voltage Vref from data line 20, transistor Q3 can be omitted to thereby reduce the number of transistors.

Furthermore, the respective values shown in this embodiment such as a voltage value are a mere example. These values are desirably set appropriately depending on the characteristics of organic EL element D1 and the specification of the image display device.

INDUSTRIAL APPLICABILITY

According to the image display device of the present invention, a pixel circuit in which a source of a driver transistor is connected to a current light-emitting element can be configured by an N-channel type transistor. The image display device of the present invention is useful as an active matrix-type image display device using a current light-emitting element.

What is claimed is:

1. An image display device, comprising:

a pixel circuit, the pixel circuit including:

a current light-emitting element;

an N-type driver transistor for flowing current in the current light-emitting element;

a retention capacitor for retaining a retention voltage applied to the N-type transistor;

an N-type writing switch transistor for writing the retention voltage to the retention capacitor based on an image signal;

an N-type enable switch transistor wherein a drain of the N-type enable switch transistor is connected to a source of the N-type driver transistor and a source of the N-type enable switch transistor is connected to an anode of the current light-emitting element;

an initialization capacitor; and an N-type separation switch transistor, wherein a first electrode of the retention capacitor is connected to a gate of the N-type driver transistor and a second electrode of the retention capacitor is connected to a first electrode of the initialization capacitor, wherein a second electrode of the initialization capacitor is connected to a trigger line, the trigger line supplying a trigger signal for initializing the retention voltage of the retention capacitor, wherein a drain of the N-type separation switch transistor is connected to the second electrode of the retention capacitor and the first electrode of the initialization capacitor, and wherein a source of the N-type separation switch transistor is connected to a source of the N-type driver transistor.

2. The image display device according to claim 1, wherein the trigger signal supplied to the trigger line is a control signal for controlling the N-type enable switch transistor.

3. The image display device according to claim 1, wherein the pixel circuit further includes an N-type reference switch transistor for applying a reference voltage to the gate of the N-type driver transistor.

4. The image display device according to claim 1, further comprising:

a plurality of pixel circuits.

5. A pixel circuit, comprising:

a current light-emitting element;

an N-type driver transistor for flowing current in the current light-emitting element;

a retention capacitor for retaining a retention voltage applied to the N-type transistor;

an N-type writing switch transistor for writing the retention voltage to the retention capacitor based on an image signal;

an N-type enable switch transistor wherein a drain of the N-type enable switch transistor is connected to a source of the N-type driver transistor and a source of the N-type enable switch transistor is connected to an anode of the current light-emitting element;

an initialization capacitor; and an N-type separation switch transistor, wherein a first electrode of the retention capacitor is connected to a gate of the N-type driver transistor and a second electrode of the retention capacitor is connected to a first electrode of the initialization capacitor, wherein a second electrode of the initialization capacitor is connected to a trigger line, the trigger line supplying a trigger signal for initializing the retention voltage of the retention capacitor, wherein a drain of the N-type separation switch transistor is connected to the second electrode of the retention capacitor and the first electrode of the initialization capacitor, and wherein a source of the N-type separation switch transistor is connected to a source of the N-type driver transistor.

6. The image display device according to claim 1, wherein the first electrode of the initialization capacitor generates voltage change of $\Delta V \cdot C2/(C1+C2)$, where C1 is a capacitance of the retention capacitor, C2 is a capacitance of the initialization capacitor, and ΔV is adjusted so that voltage of the retention capacitor is higher than threshold voltage of the N-type driver transistor.

7. The image display device according to claim 1, wherein the gate of the N-type driver transistor is connected to a data line, and $VC1=Vth+C2\cdot Vdata/(C1+C2)$ is satisfied, where C1 is a capacitance of the retention capacitor, C2 is a capacitance of the initialization capacitor, VC1 is voltage of the retention capacitor, Vth is a threshold voltage of the N-type driver transistor, and Vdata is a voltage supplied to the data line.

* * * * *